US006260297B1

(12) United States Patent
Schmees

(10) Patent No.: US 6,260,297 B1
(45) Date of Patent: Jul. 17, 2001

(54) CASE EJECTING DEVICE FOR A LARGE-CALIBER BARREL WEAPON

(75) Inventor: Heiner Schmees, Celle (DE)

(73) Assignee: Rheinmetal W & M GmbH, Unterlüss (DE)

( * ) Notice: Subject to any disclaimer, the term of this patent is extended or adjusted under 35 U.S.C. 154(b) by 0 days.

(21) Appl. No.: 09/401,535

(22) Filed: Sep. 22, 1999

(30) Foreign Application Priority Data

Sep. 22, 1998 (DE) ..... 198 43 294

(51) Int. Cl.[7] ..... F41A 15/00
(52) U.S. Cl. ..... 42/25
(58) Field of Search ..... 49/25, 46, 47

(56) References Cited

U.S. PATENT DOCUMENTS

| | | | | |
|---|---|---|---|---|
| 3,584,532 | * | 6/1971 | Stoner | 80/47 |
| 3,677,133 | * | 7/1972 | Bushey | 89/27 |
| 3,733,729 | * | 5/1973 | Baker | 42/23 |
| 3,735,517 | * | 5/1973 | De Hass et al. | 42/23 |
| 4,269,108 | * | 5/1981 | Stoner | 89/33 |
| 4,269,109 | * | 5/1981 | Stoner | 89/198 |
| 4,920,677 | * | 5/1990 | Schuerman | 42/16 |
| 4,942,802 | * | 7/1990 | Stoner | 89/191.01 |
| 5,289,755 | | 3/1994 | Zielinski et al. . | |
| 5,307,724 | * | 5/1994 | Breuer et al. | 89/24 |

FOREIGN PATENT DOCUMENTS

| | | |
|---|---|---|
| 41 33 618 | 2/1997 | (DE) . |
| 0 089 942 | 9/1983 | (EP) . |

* cited by examiner

*Primary Examiner*—Charles T. Jordan
*Assistant Examiner*—M. Thomson
(74) *Attorney, Agent, or Firm*—Venable; Gabor J. Kelemen

(57) ABSTRACT

A weapon includes a barrel having a barrel axis and a breech-side end having an end face; a breech ring affixed to the breech-side end; and a catching and ejecting device movable parallel to the barrel axis for immobilizing a rimless cartridge case in and extracting the cartridge case from the barrel. The catching and ejecting device has a pivotally supported ejector; an extractor claw mounted at an end of the ejector and arranged for engaging into an ejector groove of the cartridge case; a spring biasing the ejector for urging the extractor claw generally radially inwardly; and a guide member mounted on an end of the ejector for contacting the cartridge case during cartridge feed into the barrel whereby the ejector and the extractor claw are pivoted against a force of the spring for maintaining the extractor claw out of contact with the cartridge case. The extractor claw is moved by the force of the spring into the ejector groove of the cartridge case as the guide member runs off and remains behind the cartridge case during cartridge feed. A locking pocket is provided in the end face of the barrel end for receiving a portion of the extractor claw upon completion of the cartridge feed and while the extractor claw engages into the ejector groove of the cartridge case.

8 Claims, 4 Drawing Sheets

FIG.6
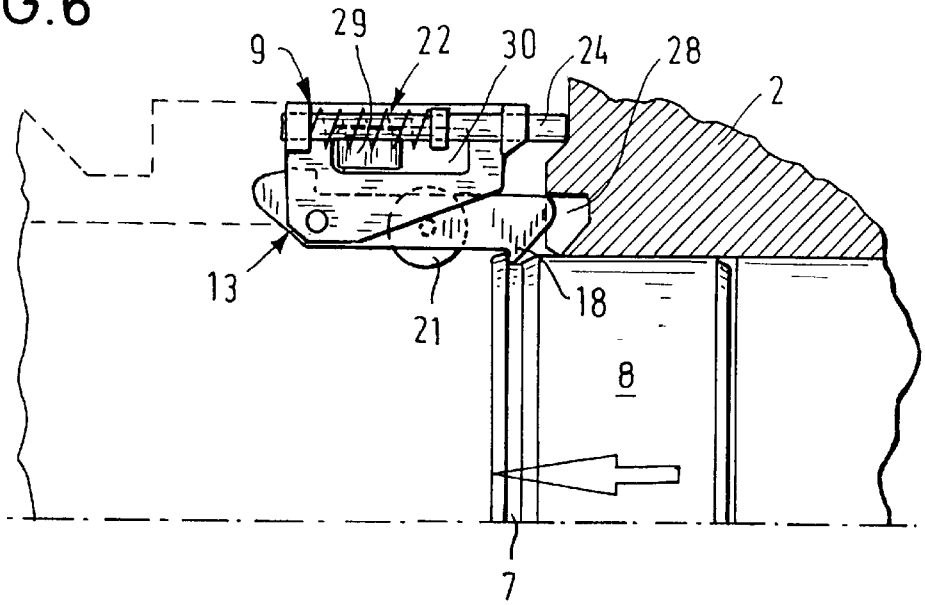
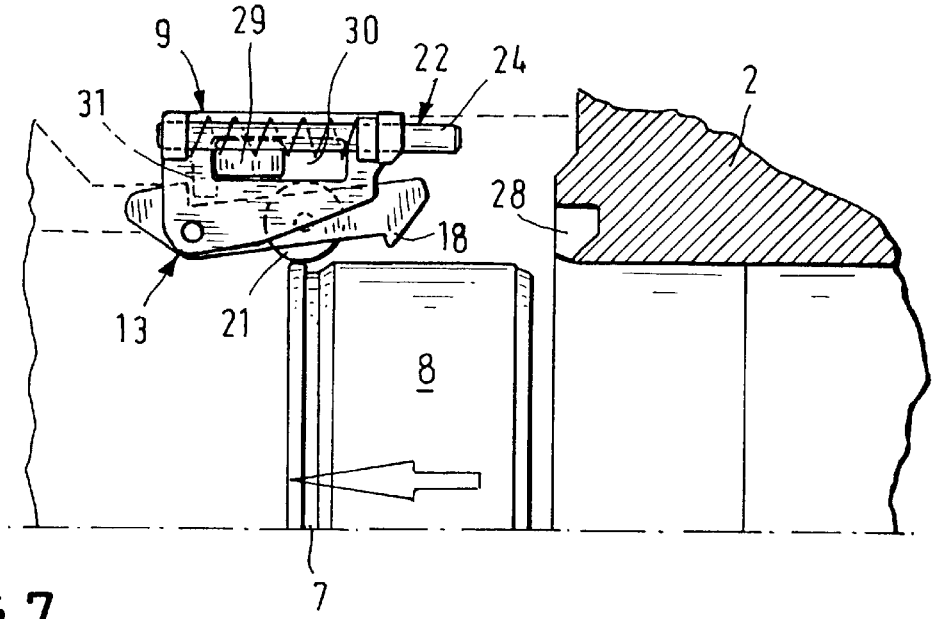
FIG.7

CASE EJECTING DEVICE FOR A LARGE-CALIBER BARREL WEAPON

CROSS REFERENCE TO RELATED APPLICATION

This application claims the priority of German Application No. 198 43 294.1 filed Sep. 22, 1998, which is incorporated herein by reference.

BACKGROUND OF THE INVENTION

This invention relates to a weapon which includes a large-caliber barrel, a breech ring affixed to the barrel at the breech end thereof and at least one catching and ejecting device for immobilizing and extracting rimless cartridge cases.

A weapon of the above-outlined type is disclosed, for example, in German Patent No. 41 33 618 to which corresponds U.S. Pat. No. 5,307,724. The weapon described therein has two oppositely located catching and ejecting devices each having an ejector which is linearly displaceable parallel to the barrel axis and which has an extractor claw. The two ejectors have openings into which extend pivotal ejector levers so that upon pivoting the ejector lever a linear displacement of the ejector results. Further, the weapon barrel has on its end oriented towards the breech ring, two locking pockets into which the extractor claws, extending into the ejector groove of the cartridge case, are pressed after completion of the cartridge feed to prevent the cartridge bottom from being pushed into the propellant chamber of the barrel.

It is, among others, a disadvantage of the above-outlined conventional weapon that during the cartridge feed the extractor claws glide on the cartridge case until they fall into the extractor groove of the cartridge case. Such an occurrence may damage the cartridge case particularly if it is made of a thin, combustible material.

SUMMARY OF THE INVENTION

It is an object of the invention to provide an improved large-caliber weapon of the above-outlined type in which a damaging of the cartridge case by the catching and ejecting mechanism is securely avoided.

This object and others to become apparent as the specification progresses, are accomplished by the invention, according to which, briefly stated, the weapon includes a barrel having a barrel axis and a breech-side end having an end face; a breech ring affixed to the breech-side end; and a catching and ejecting device movable parallel to the barrel axis for immobilizing a rimless cartridge case in and extracting the cartridge case from the barrel. The catching and ejecting device has a pivotally supported ejector; an extractor claw mounted at an end of the ejector and arranged for engaging into an ejector groove of the cartridge case; a spring biasing the ejector for urging the extractor claw generally radially inwardly; and a guide member mounted on an end of the ejector for contacting the cartridge case during cartridge feed into the barrel, whereby the ejector and the extractor claw are pivoted against a force of the spring for maintaining the extractor claw out of contact with the cartridge case. The extractor claw is moved by the force of the spring into the ejector groove of the cartridge case as the guide member runs off and remains behind the cartridge case during cartridge feed. A locking pocket is provided in the end face of the barrel end for receiving a portion of the extractor claw upon completion of the cartridge feed and while the extractor claw engages into the ejector groove of the cartridge case.

Essentially, the invention is based on the principle to mount a guide member, preferably a roller, on the ejector of the catching and ejecting mechanism in such a manner that the guide member, during cartridge feed, rides on the cartridge case and pivots away the ejector against a spring force so that ejector claw remains out of contact with the cartridge case. Upon completion of the cartridge feed, the guide member runs off the cartridge case and the extractor claw is pressed by the spring into the ejector groove of the cartridge case.

The guide members have the further advantage that the cartridge is guided laterally during the loading process (cartridge feed).

According to a preferred embodiment of the invention, to prevent the extraction claw from engaging into the locking pocket of the weapon barrel before completion of the cartridge feed, on the catching and ejecting mechanism a buffer is provided which is formed preferably of a spring-biased pressing rod and which supports the catching and ejecting device axially at the end of the weapon barrel. Further, the buffer dampens the impact of the cartridge as it arrives into the cartridge chamber.

BRIEF DESCRIPTION OF THE DRAWINGS

FIGS. 6 and 7 are schematic sectional top plan views of the catching and ejecting device depicted at different moments during the extraction of a cartridge case from the weapon chamber.

DESCRIPTION OF THE PREFERRED EMBODIMENT

Figure 1:
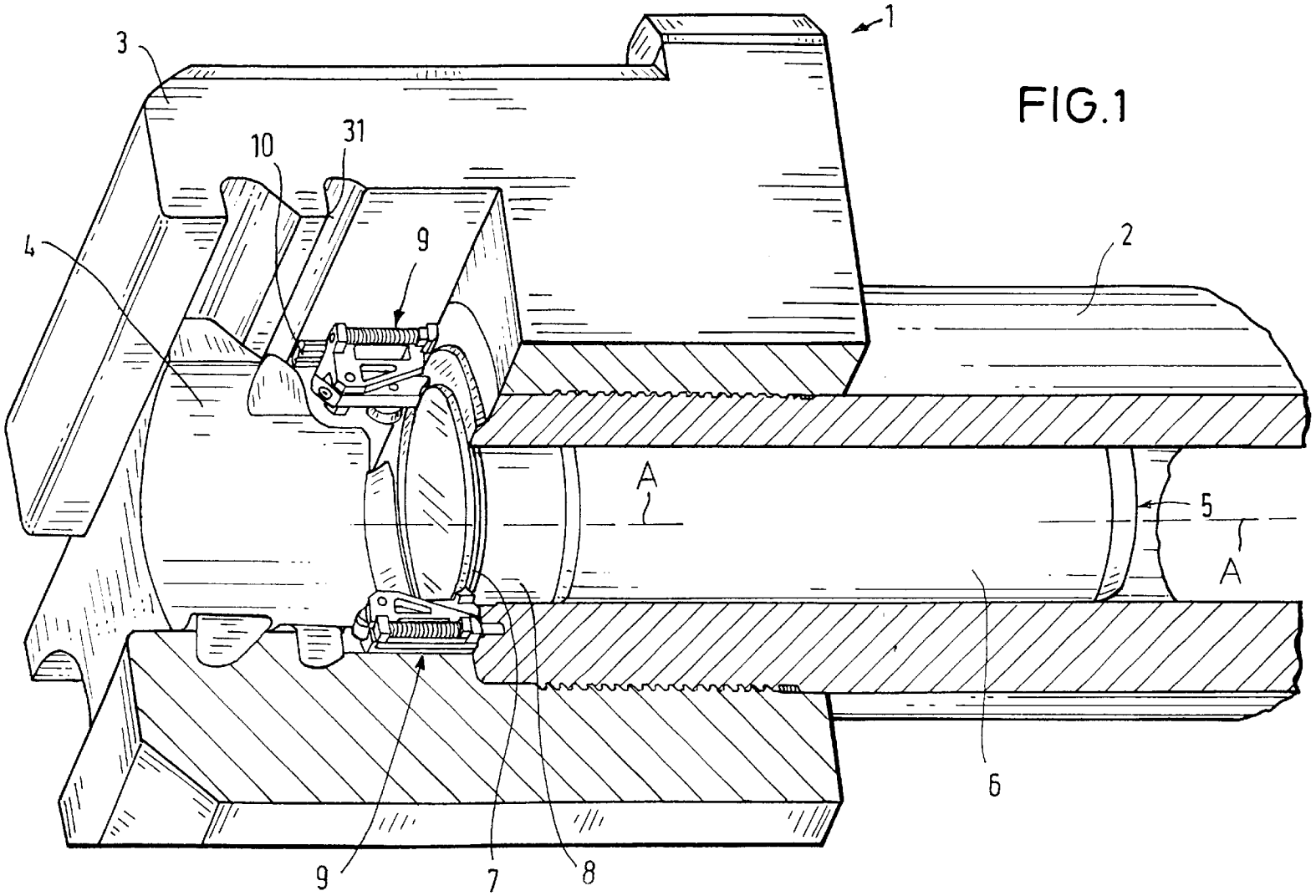
FIG. 1 is a perspective, broken-away view of the so breech side region of a weapon barrel having two catching and ejecting devices structured according to a preferred embodiment of the invention.

Turning to FIG. 1, the rear (breechblock side) region 1 of a large-caliber weapon (for example, a 120 mm tank cannon) comprises a weapon barrel 2 having a barrel axis A, a breech ring 3 and a breechblock wedge 4 shiftable in the breech ring 3. A cartridge 5 is positioned in the chamber of the barrel 2. Of the cartridge 5 there is illustrated only its combustible cartridge case 6 having a rimless metal case bottom 8 which is provided with a circumferential ejection groove 7.

On the breech ring 3 two diametrically oppositely located catching and ejecting devices 9 are mounted, each being shiftable axially along respective dovetail guides 10 secured to the breech ring 3.

Figure 2:
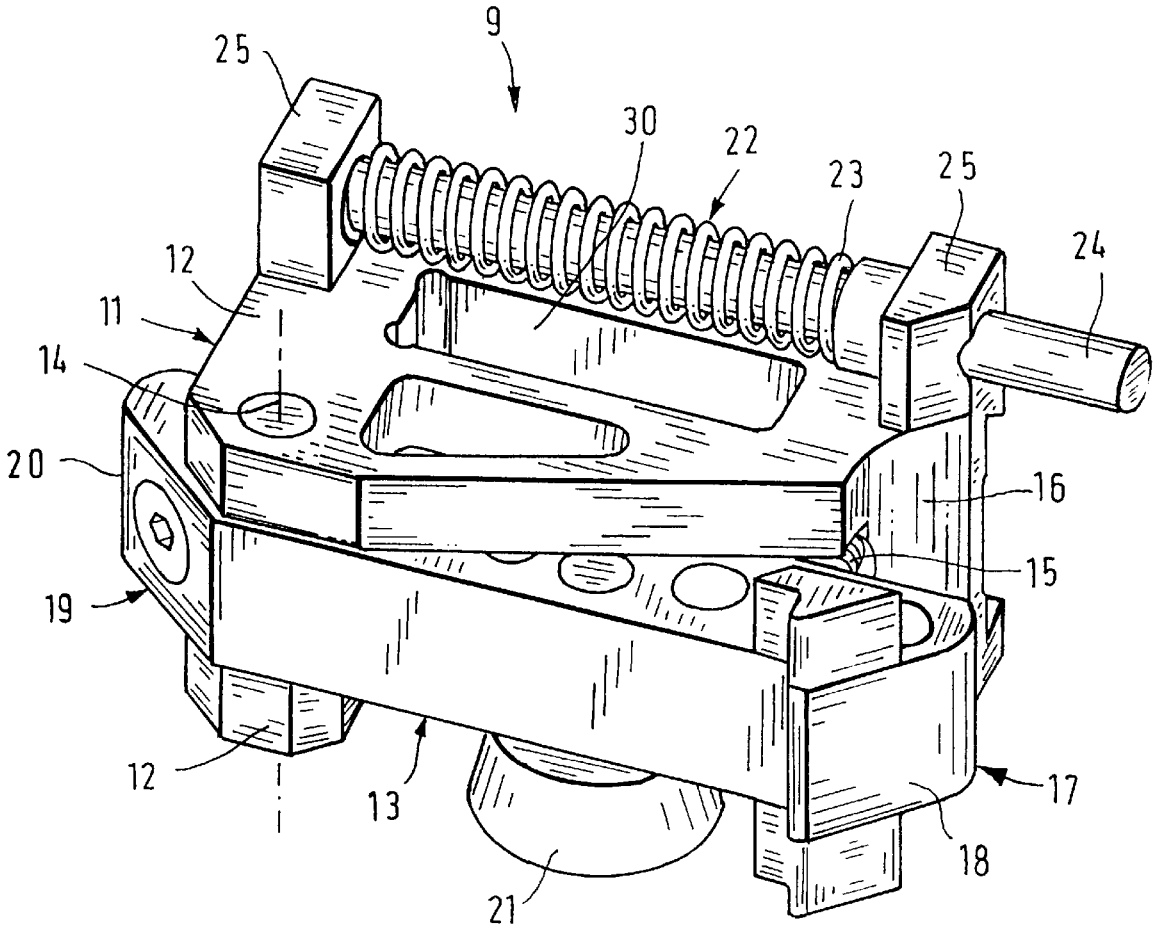
FIG. 2 is an enlarged perspective view of one of the catching and ejecting devices illustrated in FIG. 1.

FIG. 2 illustrates the structure of one of the catching and ejecting devices 9 in more detail. The other device 9 is of identical construction. The device 9 is essentially composed of a yoke frame 11 having two spaced yoke plates 12 and a base plate 16 connecting the yoke plates 12 to one another. An ejector 13 is supported between the yoke plates 12 for pivotal motion about an axis 14. The ejector 13 is supported on the base plate 16 of the frame 11 by a compression spring 15. At its frontal end 17 the ejector 13 has an extractor claw 18 while at its rearward end 19 it has a resilient sheet metal member 20. Further, the ejector 13 rotatably supports a roller (guide member) 21, by means of which the ejector 13 engages and rides on the contour of the cartridge case 6 as it is advanced into the weapon chamber.

At the upper yoke plate 12 of the frame 11 a buffer 22 is arranged which is formed essentially by a pressing rod 24 biased by a spring 23. The pressing rod 24 is guided in apertured blocks 25 affixed to the upper yoke plate 12.

In the description which follows the operation of the above-described catching and ejecting device 9 will be set forth in conjunction with FIGS. 3–7.

Figure 3:
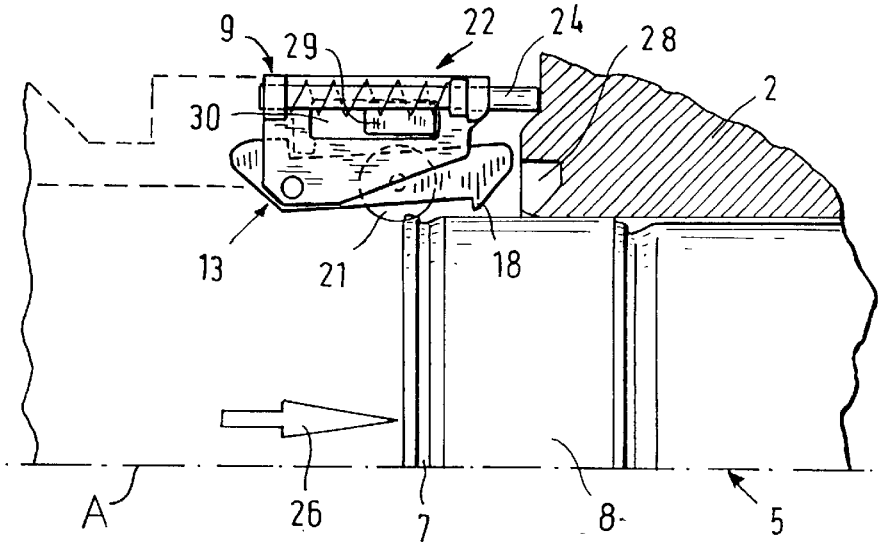
FIGS. 3, 4 and 5 are schematic sectional top plan views of the catching and ejecting device depicted at different moments during the feed of a cartridge into the chamber of the weapon barrel.
Figure 4:
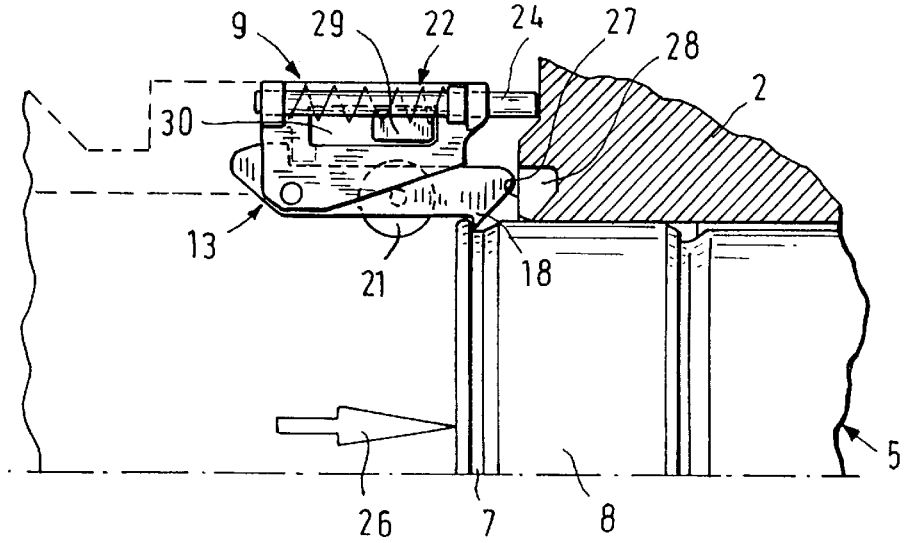
Figure 5:
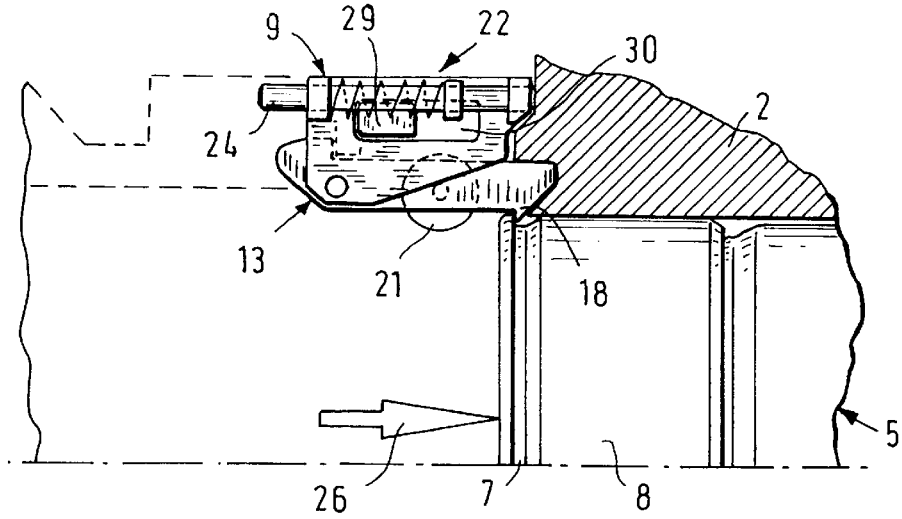

FIGS. 3, 4 and 5 show the loading step (cartridge feed) for the cartridge 5. In the position shown in FIG. 3 the catching and ejecting device 9 is still in contact with the cartridge bottom 8 by means of the roller 21. Such a contact causes the extracting claw 18 to be slightly raised over the cartridge case, thus securely avoiding damage thereto. The catching and ejecting device 9 is supported axially on the barrel end with the intermediary of the buffer assembly 22–25.

When the cartridge 5, for example, by means of a loading member symbolically indicated by the arrow 26 is pushed further into the barrel, the case bottom 8 leaves the roller 21 behind, and the compression spring 15 (FIG. 2) presses the extracting claw 18 automatically into the ejecting groove 7 of the case bottom 8 as depicted in FIG. 4.

Thereafter the cartridge 5 is, by means of the loading member 26, pushed further into the barrel 2 until the outer face of the case bottom 8 is flush with the radial outer face 27 of the barrel 2, at which time each extracting claw 18 is accommodated in a formfitting manner in the respective locking pocket 28 of the barrel 2 as illustrated in FIG. 5. During this occurrence the kinetic energy of the buffer 22 is partially reduced.

Thereafter, the breechblock wedge 4 first executes a partial stroke so that the cartridge 5 cannot be pushed backward by the spring-loaded buffer 22 and the loading member 26 is retracted. As a subsequent step, the breechblock wedge 4 is pushed entirely into its bolting (locking) position.

After the cartridge 5 is fired, the breechblock wedge 4 is pulled back and the catching and ejecting devices 9 are pulled rearward by means of ejector levers 29 which extend into respective recesses 30 of the frame 11 and carry with them the case bottom 8 by means of the extractor claws 18. The earlier-noted U.S. Pat. No. 5,307,724 which is incorporated herewith by reference, describes in more detail the function and structure of the ejector lever (designated at 4 in that patent). As shown in FIG. 6, while the extractor claws 18 move slightly outward of the locking pockets 28, they continue to be maintained by the locking pockets 28 against the force of the spring 15 in their position in which they engage into ejector groove 7 of the case bottom 8.

As the case bottom 8 continues to be pulled out of the barrel 2, the rearward end 19 of each ejector 13 abuts the respective abutment edge 31 at the breech ring 3 (FIG. 1), whereby the extractor claws 18 are pivoted into their respective open position, so that the case bottom 8 may be ejected, as shown in FIG. 7.

It is to be understood that the invention is not limited to the above-described embodiment. Thus, instead of a dovetail guide, any other suitable guide may be used for an axial displacement of the catching and ejecting device. Furthermore, the invention may find application not only in weapons for firing ammunition with one-part or multi-part combustible cartridges cases but may also be used with ammunition where the cartridge cases are made entirely of metal. Dependent on the weight of such cartridge cases it may be necessary to use more than two catching and ejecting devices which would then be uniformly distributed about the circumference of the breech ring.

It will be understood that the above description of the present invention is susceptible to various modifications, changes and adaptations, and the same are intended to be comprehended within the meaning and range of equivalents of the appended claims.

What is claimed is:

1. A weapon comprising (a) a barrel having a barrel axis and a breech-side end having an end face;

(b) a breech ring affixed to said breech-side end; said end face being oriented toward said breech ring;

(c) a catching and ejecting device movable parallel to said barrel axis for immobilizing a rimless cartridge case in and extracting the cartridge case from said barrel; said catching and ejecting device including (1) a pivotally supported ejector having first and second ends;

(2) an extractor claw mounted on said first end of said ejector and arranged for engaging into an ejector groove of the cartridge case;

(3) a spring biasing said ejector for urging said extractor claw generally radially inwardly; and (4) a guide member mounted on said second end of said ejector for contacting the cartridge case during cartridge feed into said barrel whereby said ejector and said extractor claw are pivoted against a force of said spring for maintaining said extractor claw out of contact with said cartridge case and said extractor claw is moved by the force of said spring into the ejector groove of the cartridge case as the guide member runs off and remains behind the cartridge case during cartridge feed; and (d) a locking pocket provided in said end face of said barrel end; said locking pocket receiving a portion of said extractor claw upon completion of the cartridge feed and while the extractor claw engages into the ejector groove of the cartridge case.

2. The weapon as defined in claim 1, wherein said guide member is a roller.

3. The weapon as defined in claim 1, further comprising a buffer mounted on said catching an ejecting device for abutting said end face of said barrel end for preventing said portion of said extractor claw from entering said locking pocket prior to completion of the cartridge feed.

4. The weapon as defined in claim 3, wherein said buffer comprises a spring biased pressing bar adapted to abut said end face.

5. The weapon as defined in claim 1, further comprising an abutment provided on said breech ring and facing said second end of said second end of said ejector whereby said second end engages said abutment upon conclusion of an opening stroke of said ejector for causing a pivotal motion of said ejector claw out of the ejector groove of the cartridge case.

6. The weapon as defined in claim 1, further comprising a dovetail guide mounting said catching and ejecting device to said breech ring and guiding said catching and ejecting device parallel to said barrel axis.

7. The weapon as defined in claim 1, wherein said catching and ejecting device is present in a plurality; the catching and ejecting devices are distributed uniformly about said breech ring.

8. The weapon as defined in claim 1, wherein said catching and ejecting device comprises a frame supporting said ejector, said spring and said guide member; said frame having a recess to be engaged by an ejector lever for effecting displacement of said catching and ejecting device parallel to said barrel axis.

* * * * *